US005214738A

United States Patent [19]

Nakajima et al.

[11] Patent Number: 5,214,738

[45] Date of Patent: May 25, 1993

[54] POSITIVE COEFFICIENT THIN-FILM THERMISTOR

[75] Inventors: Shigeaki Nakajima, Kanagawa; Hiroshi Waki, Tokyo; Nobuhiro Fukuda; Hiroyuki Hyakutake, both of Kanagawa; Masanaga Kikuzawa, Chiba, all of Japan

[73] Assignee: Mitsui Toatsu Chemicals, Inc., Tokyo, Japan

[21] Appl. No.: 667,382

[22] PCT Filed: May 10, 1990

[86] PCT No.: PCT/JP90/00593

§ 371 Date: Mar. 22, 1991

§ 102(e) Date: Mar. 22, 1991

[87] PCT Pub. No.: WO91/02365

PCT Pub. Date: Feb. 21, 1991

[30] Foreign Application Priority Data

Aug. 7, 1989 [JP] Japan ..... 1-202877
Aug. 7, 1989 [JP] Japan ..... 1-202878

[51] Int. Cl.[5] ..... H01C 7/10
[52] U.S. Cl. ..... 338/22 R; 338/28
[58] Field of Search ..... 338/25, 22 R, 22 SD, 338/28

[56] References Cited

U.S. PATENT DOCUMENTS 4,906,968 3/1990 Gersherfeld et al. ..... 338/25
4,951,028 8/1990 Tuller ..... 338/22 R

FOREIGN PATENT DOCUMENTS 016263 10/1980 European Pat. Off. .
036247 9/1981 European Pat. Off. .

OTHER PUBLICATIONS

Patent Abstracts of Japan, vol. 13, No. 110 (E-728), Mar. 16, 1989 and JPA-63281401.
Journal of Materials Science Letters, vol. 8, No. 4, Apr. 1989, pp. 411-414.

*Primary Examiner*—Marvin M. Lateef
*Attorney, Agent, or Firm*—Burns, Doane, Swecker & Mathis

[57] ABSTRACT

A positive coefficient thin-film thermistor which is a thin film exhibiting a positive temperature coefficient (PTC) characteristic and having a thickness of 0.005 to 5 μm and electrodes as constituting elements, and wherein the thin film is compound of a barium titanate based composition and the PTC characteristic is represented by a resistance variation in the transition of region of 1-10 orders of magnitude and a maximum resistance temperature variation rate of 1-20 orders/°C.

6 Claims, 4 Drawing Sheets

POSITIVE COEFFICIENT THIN-FILM THERMISTOR

BACKGROUND OF THE INVENTION

1. Field of the Invention

The present invention relates to a thermistor having a positive coefficient (hereinafter referred to as PTC (positive temperature coefficient) characteristic) where electric resistance remarkably increases with an increase in temperature, particularly relates to a thin-film thermistor having the PTC characteristic, and more particularly relates to a PTC thin-film thermistor obtained by utilizing a barium titanate based composition.

2. Description of the Related Art

A PTC characteristic has conventionally been known in bulk materials of barium titanate based semiconductor ceramics obtained by adding rare earth elements such as Y and La to bulk barium titanate and burning the mixture in the air at 1200°-1400° C. Heaters and temperature sensors have been prepared by utilizing the characteristic. The maximum resistance variation rate has been at most about 0.1 order/°C. and has been very unsatisfactory. The temperature where electric resistance increases can be shifted to a low temperature side or a high temperature side by replacing a portion of the Ba sites in said ceramic materials with Sr or Pb, respectively. Thus said temperature can be arbitrarily changed in the range of from −30° C. to 300° C.

However, according to the information of the inventors, conventional PTC thermistors have been very small in maximum resistance variation rate and prepared by mixing and burning oxide of each constituting element such as Ti and Ba in prescribed concentration. Consequently, these thermistors inevitably have a large thickness and also result in large resistance at room temperature. These problems must be overcome by enlarging the area of electric circuit to reduce resistance.

SUMMARY OF THE INVENTION

The present inventors have found that, even in a very thin thickness, for example, a film thickness of 5 μm or less, a thin-film thermistor has a satisfactory PTC characteristic and surprisingly exhibits a resistance variation in a transition region of from 1 to 10 orders of magnitude and a maximum resistance variation rate to temperature change of from 1 to 20 orders/° C. which values are steep PTC characteristics far exceeding the anticipation of persons who are skilled in the art. Thus, the present invention has been completed.

One aspect of the present invention is a positive coefficient thin-film thermistor comprising a thin-film which exhibits a PTC characteristic and has a thickness of from 0.005 to 5 μm and electrodes, particularly is a positive coefficient thin film thermistor having resistance variation in the transition region of from 1 to 10 orders of magnitude and a maximum resistance variation rate to temperature change of from 1 to 20 orders/°C., and preferably is a positive coefficient thin-film thermistor comprising a thin film of a barium titanate based composition.

Generally, ceramic semiconductors conventionally obtained by sinter-burning of oxide powder have a considerably large size and can only form a thin film having a thickness of at least about 1 mm. Even though the thickness can be further decreased to a certain extent, the thickness becomes irregular and the resulting thermistor cannot exhibit satisfactory performance.

On the other hand, the thermistor of the present invention uses a thin film having a thickness of from 0.005 to 5 μm and a PTC characteristic and thus exhibits a resistance variation in a transition region of from 1 to 10 orders of magnitude and a maximum resistance variation rate to temperature change of from 1 to 20 order/°C., which PTC characteristics are far exceeding the anticipation of persons who skilled in the art.

1 . . . Substrate, 2 . . . Electrode layer, 3 . . . Thin film exhibiting a PTC characteristic, 4,5,6 . . . Contact electrode, 7 . . . Substrate, 8 . . . Thin film exhibiting a PTC characteristic, 9,10,11 . . . Contact electrode, 12 . . . Substrate, 13 . . . Thin film exhibiting a PTC characteristic, and 14 . . . Electrode

DESCRIPTION OF THE PREFERRED EMBODIMENTS

In the thin-film thermistor of the present invention, the minimum thickness which exhibits the PTC characteristic is 0.005 μm and a preferred film thickness is 0.05 μm or more. The maximum film thickness is about 5 μm in view of uniformity of the film and operation conditions in forming the thin film. In order to consistently obtain the characteristic in particular, the preferred film thickness is from 0.1 to 3 μm.

Particular attention should be called to the fact that "the thin-film thermistor" of the invention itself is quite novel and should be distinctly distinguished from conventional so-called "thick-film thermistor".

Figure 1:
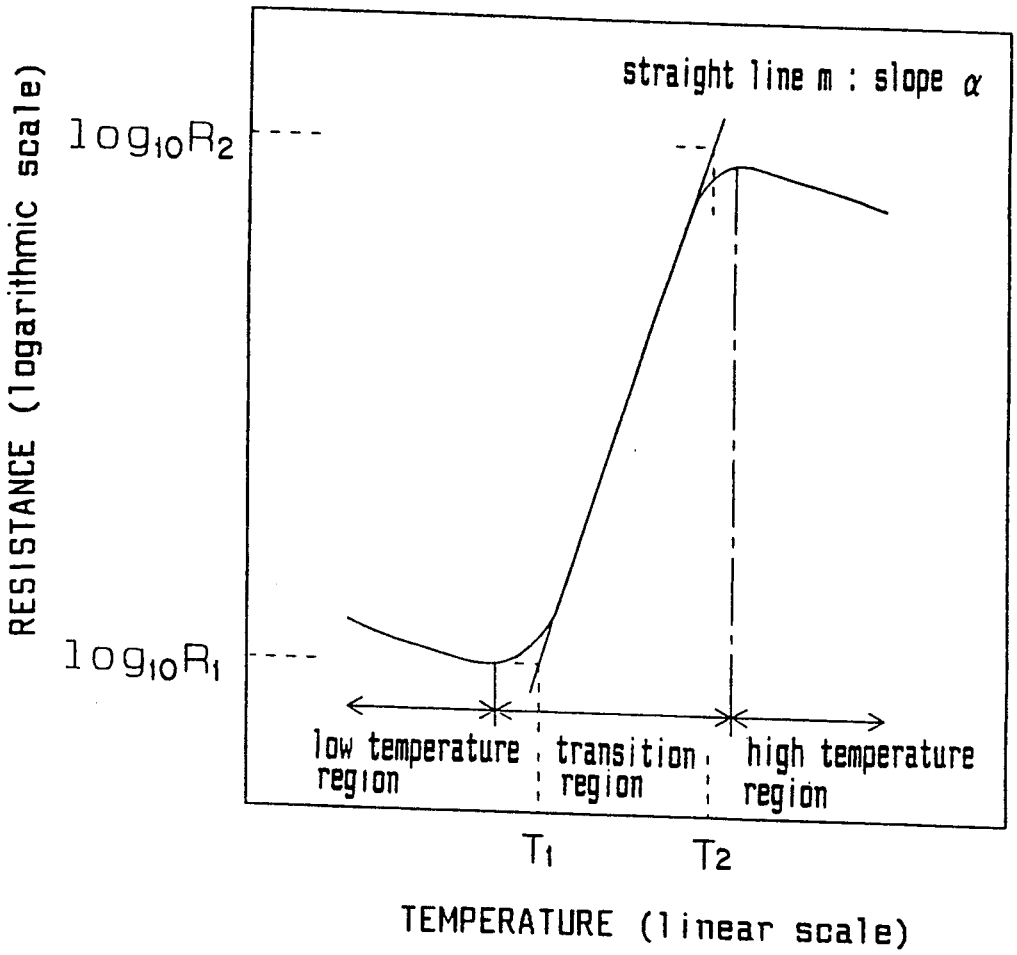
FIG. 1 PRIOR ART
FIG. 1 is a schematic diagram conceptually illustrating a typical resistance temperature dependence of a PTC characteristic.

A typical resistance temperature dependence of the PTC characteristic is schematically illustrated in FIG. 1. In the drawing, the PTC characteristic is roughly divided into 3 temperature regions.

That is, a region where resistance slowly decreases from the start of temperature rise (low temperature region), a region where resistance rapidly increases (transition region), and a region where resistance slowly decreases again (high temperature region). In certain cases, however, resistance is substantially constant or slowly increases in the low temperature region or the high temperature region.

In the present invention, the proportion of increased orders of magnitude in resistance (indicated with a logarithmic scale) to temperature change in the transition region is defined as "a resistance temperature variation rate" and the unit for use is order/°C. The maximum value of the resistance temperature variation rate is also defined as "a maximum resistance temperature variation rate". Consequently, the maximum resistance temperature variation rate is the maximum value of the slope of the curve in the transition region.

In FIG. 1, a straight line m indicates a maximum slope in the transition region, and the slope $\alpha$ of the straight line is "the maximum resistance temperature variation rate" in the case.

$\alpha$ can be calculated from the equation (1):

$$\alpha=(\log_{10}R_2-\log_{10}R_1)/(T_2-T_1) \quad (1)$$

Figure 3:
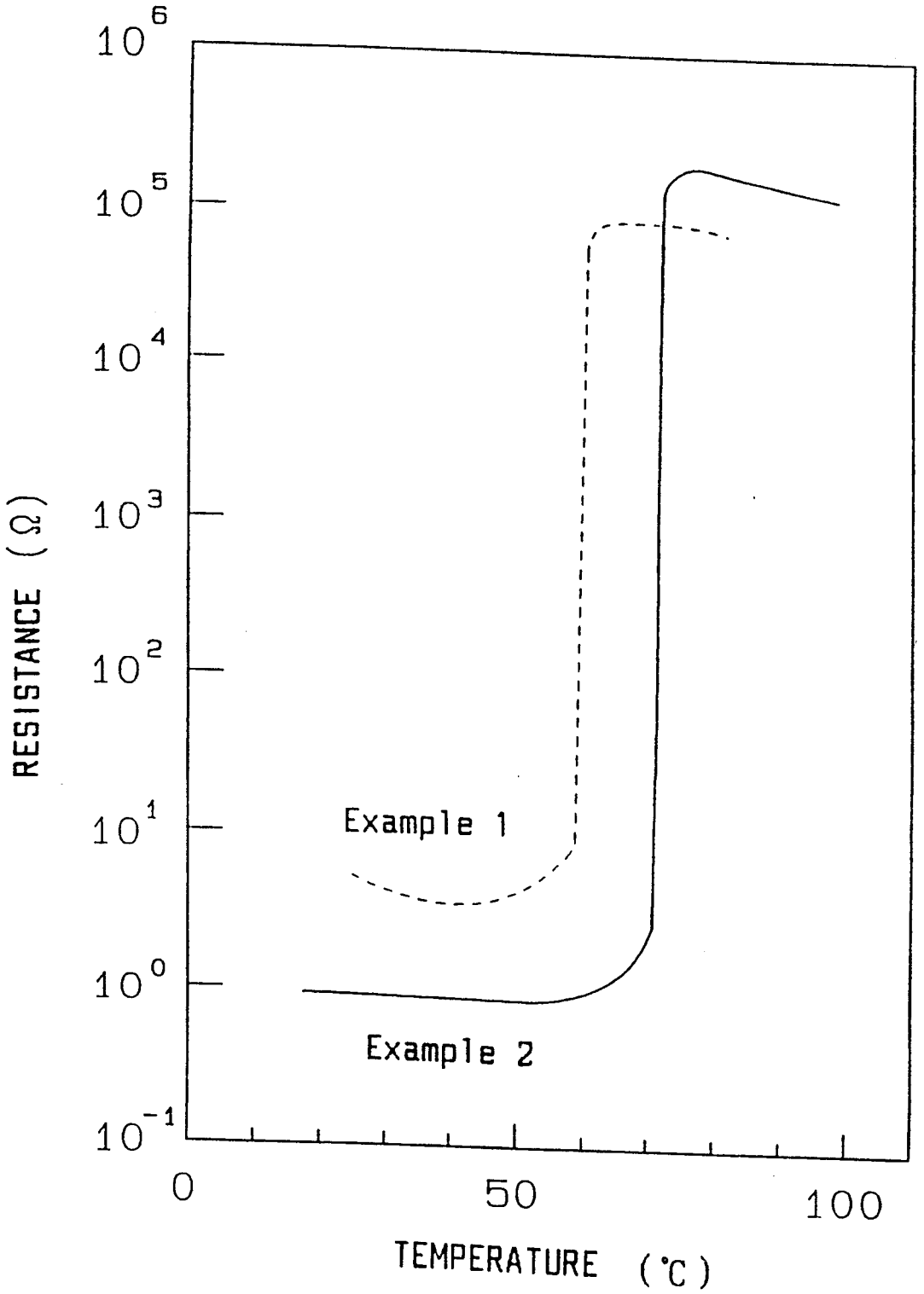
FIG. 3 is a graph illustrating the relationship between temperature and resistance in Example 1 and Example 2 of the invention.

FIG. 3 indicates results on the PTC characteristics of thin films in the examples of the invention.

Figure 4:
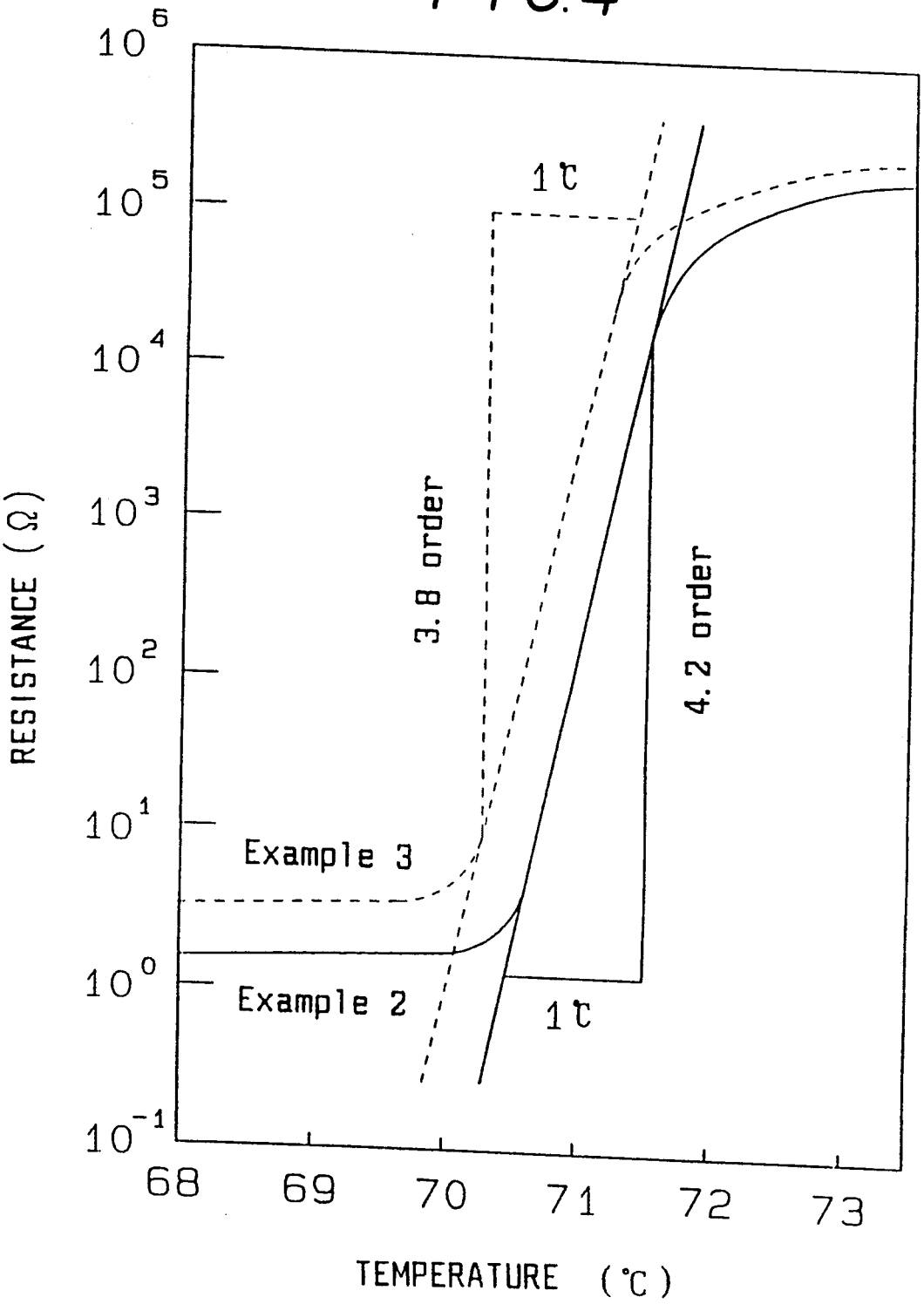
FIG. 4 is a graph illustrating an enlarged view of relationship between temperature and resistance in Example 2 and Example 3.

FIG. 4 illustrates a method for determining $\alpha$ on the diagram of examples. $\alpha$ can be determined with ease by making an enlarged plotting of the temperature scale in the surrounding of the transition region.

In the thin-film PTC thermistor of the invention, resistance variation in the transition region is from 1 to 10 orders of magnitude(variation of one order of magnitude corresponds to 10 times of resistance variation) and the maximum resistance temperature variation rate is in the range of from 1 to 20 orders/°C.

The thermistor of the invention naturally requires as constituting elements at least one thin film exhibiting the PTC characteristic and at least one electrode for taking out the variation of electrical properties exhibited by said thin film. The form of electrical contact can be optionally selected, as illustrated, for example, in FIG. 2.

Figure 2:
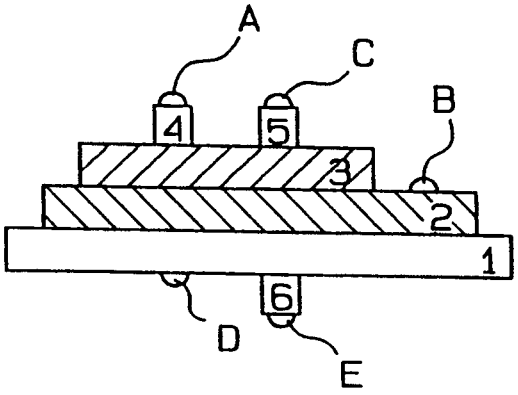
FIG. 2(*a*), (*b*) and (*c*) are schematic diagrams practically illustrating an example of a thin-film thermistor of the present invention.
Figure 2:
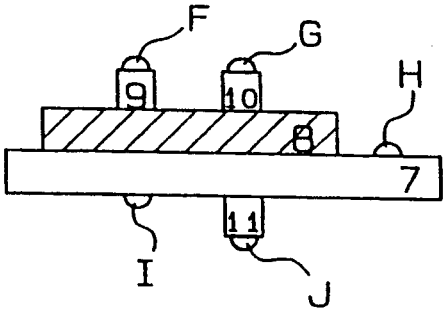
Figure 2:
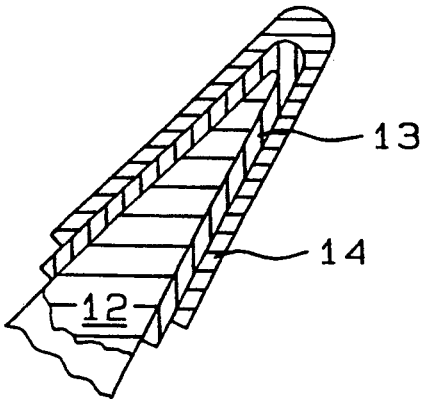

In FIG. 2(*a*), 1 is a substrate, 2 is an electrode layer, 3 is a thin film exhibiting the PTC characteristic, 4 and 5 are contact electrodes. Electrical contact can be carried out in a sandwich form by using point A and point B, or in a coplanar form by using point A and point C. When the substrate is electrically conductive in particular, contact can also be carried out by using point A and point D. Sometimes it is convenient to coat a contact electrode 6 and to carry out contact by using point A and point E.

In FIG. 2(*b*), the electrode layer 2 in FIG. 2(*a*) is omitted and a thin film 8 which exhibits the PTC characteristic is formed directly on the substrate 7. 9 and 10 are contact electrodes and can be contacted in a coplanar form by using point F and point G. When the substrate is electrically conductive, the electrode layer also combines the role of a substrate and the substrate is unnecessary. In such a case, contact can be carried out in a sandwich form by using point F and point H, or point F and point I. Alternatively, a contact electrode 11 is coated similarly to the case of (*a*) and contact is conveniently carried out by using point F and point J.

FIG. 2(*c*) is a schematic drawing of a probe and the substrate is a needle like conductive material or at least the substrate surface alone may be conductive. A thin film 13 having the PTC characteristic is formed on the surface and an electrode 14 is coated thereon.

The PTC characteristic may be taken out by way of the electrode from the thin film or, under certain circumstances, by way of a thin insulation film, for example, $SiO_2$ having a thickness of from 20 to 1000 Å.

Exemplary substrate which can be used is a plate of metals such as Si, Pt, Au, Ag, Ni, Ti, Al, Cr, Fe, Pd, Mg, In, Cu, Sn and Pb; stainless steel, $Al_2O_3$ and $SiO_2$.

Exemplary electrode layer which is suitable for use is made of metals such as Pt, Au, Ag, Ni, Ti, Al, Cr, Fe, Pd, Mg, In, Cu, Sn and Pb; and conductive oxides such as ITO and SnO:.

Exemplary contact electrode which is suitable for use is made of metals such as Pt, Au, Ag, Ni, Ti, Al, Cr, Fe, pd, Mg, In, Cu, Sn and Pb, or alloys such as In-Ga and solder. Pastes which contain metals such as Pt, Au, Ag, Pd and Cu can also be used.

Formation of the thin film in the invention can be accomplished by a vacuum deposition method, sputtering method, ion plating method electro deposition method or a sol-gel method (wet-coating method).

Each of the above methods will hereinafter be illustrated by way of a barium titanate based composition as an example, but it is to be understood that this is a mere example and does not limit the scope of the invention.

In the vacuum deposition method, a substrate is placed in vacuum and a barium titanate based composition can be formed on the substrate by an EB deposition method using the barium titanate based composition as a source or by a multi-element deposition method using a compound containing various constituting metals as a source. When the deposition speed is rapid, it is sometimes better to conduct it in an oxygen stream. By heating the substrate from 600° to 1000° C. during deposition, the thin film obtained can exhibit the PTC characteristic. When the substrate is not heated in the deposition step, the PTC characteristic of the resulting thin film can be obtained by heating at 600° to 1000° C. for 0.5 to 20 hours after achieving the desired film thickness.

In the thin-film preparation of a barium titanate based composition by the sputtering method, a substrate is placed in a vacuum and the composition is formed on the substrate by sputtering with argon or oxygen gas using the barium titanate base composition as a target, or by multi element sputtering using a compound containing various constituting metals as a target. Similar to the above, a thin film exhibiting the PTC characteristic can be obtained by heating the substrate at 600° to 1000° C. Alternatively, a thin film having the PTC characteristic can be obtained, though not heating the substrate in the thin film preparation, by heating the resulting film at 600° to 900° C. for 0.5 to 20 hours after obtaining the desired film thickness.

In the thin-film preparation of a barium titanate based composition by the ion plating method, a substrate is placed in a vacuum and a thin film of a barium titanate based composition is formed on the substrate by using the barium titanate based composition as a source in oxygen plasma, or by separately preparing compounds containing each constituting metal and conducting EB heating using these compounds as multi-targets. Similar to the above, a thin film having the PTC characteristic can be obtained by heating the substrate at 600° to 1000° C. Alternatively, a thin film having the PTC characteristic can be obtained, though not heating the substrate in the thin film preparation, by heating the resulting film at 600° to 900° C. for 0.5 to 20 hours after obtaining the desired film thickness.

In the thin-film preparation by the electro-deposition method, powder of a barium titanate based composition is dispersed in an organic solvent such as acetone, acetonitrile, benzonitrile, pyridine, tetrahydrofuran, propylene carbonate and nitrobenzene, an electrode is immersed into the dispersion obtained and an electric field is applied on the electrode to form a thin film of the barium titanate based composition on the surface of the electrode. A thin film exhibiting the PTC characteristic can be obtained by burning the resulting film at temperature of from 500° and 1200° for 0.5 to 20 hours after obtaining the desired film thickness.

In the preparation of a thin film of the barium titanate based composition by the sol-gel method, each constituting metal is used in the form of alkoxides such as methoxide, ethoxide, propoxide, butoxide, methoxyethoxide and ethoxyethoxide; and organic acid salts such as lower fatty acid salts, stearate, laurate, caprylate, octoate and naphthenate. These alkoxides and organic acid salts are dissolved in an organic solvent such as ethanol, propyl alcohol, isopropyl alcohol, butanol, and other alcohols, acetone, chloroform, benzene, toluene and xylene. The thus-obtained solution is uniformly applied to the surface of the substrate to obtain a thin film of the barium titanate based composition. In certain cases, the desired thickness cannot be obtained by one application alone depending upon the concentration and viscosity of the solution or method and conditions of coating. In such cases, coating procedures may be repeated is desired, for example, from 2 to 100 times. A drying or calcining step at 50° to 120° C. for 0.5 to 5 hours may be inserted between each application procedure. The thin film thus obtained can be burned at a relatively low temperature, for example, at 500° to 1200° for 0.5 to 20 hours. Thus a semiconductor ceramic composed of the barium titanate based composition is obtained.

The coating method which can be applied includes for example, spin coating, dip coating, spray coating, electro-static coating, brushing, cast coating, flow coating, blade coating, screen coating, roll coating and kiss-roll coating.

The use of metal alkoxide is liable to be affected by traces of water depending upon the kind of metal, decreases solubility of the alkoxide and sometimes causes precipitate. In such a case, addition of an active hydrogen containing compound or use of a compound having chelate forming activity enables steady and reproducible formation of the thin film having the PTC characteristic. The amount of these compounds which is added to the solution or dispersion of metal alkoxides or metal salts is in the range of from 0.0001 to 10 moles, preferably from 0.001 to 1 mole per atom of titanium (g-moles/g-atm Ti). The metal alkoxides or metal salts in the solution sometimes form colloid particles depending upon the concentration of the solution, the amount of the additives, or elapsed time after addition. The solution changes to a dispersion of colloid particles, which circumstances, however, do not impair the effect of the invention.

The active hydrogen containing compounds which can be used are compounds containing a hydroxy group, imino group or an amino group. Exemplary compounds include ethylene glycol, diethylene glycol, triethylene glycol, polyethylene glycol, monoethanolamine, diethanolamine, triethanolamine, tris [2-(2-hydroxyethoxy)ethyl]amine, N,N-bis(2-hydroxyethyl)-2-(2-aminoethoxy)ethanol, N,N-bis [2-(2-hydroxyethoxy)ethyl]-2-aminoethanol, monoisopropanolamine, diisopropanolamine, triisopropanolamine, mono(2-hydroxyisopropyl)amine, bis(2-hydroxyisopropyl)amine and tris(2-hydroxyisopropyl)-amine.

Compounds which have chelate forming activity include, for example, acetylacetone, trifluoroacetylacetone, hexafluoroacetylacetone, 3-phenylacetylacetone, benzoyltrifluoroacetone, furoyltrifluoroacetone, pivaloyltrifluoroacetone, thenoyltrifluoroacetone, dibenzoylmethane, dipivaloylmethane, heptafluorobutanoylpivaloylmethane, and polycarboxylic acids such as oxalic acid, ethylenediaminediacetic acid, ethylenediaminetetraacetic acid, diaminopropanoltetraacetic acid, diaminopropanetetraacetic acid, glycoletherdiaminetetraacetic acid, iminodiacetic acid, hydroxyethyliminodiacetic acid, nitrilotriacetic acid and nitrilotripropionic acid.

The metals which constitute the barium titanate based composition of the invention comprises Ti, Ba, Sr, Si, Mn and dope metals. Assuming that the number of Ti atoms is 1 g-atom Ti in the composition, the preferred proportion of each metal other than Ti by g-atms metal/g-atm Ti is:

$$Ba=1\text{–}0.5,\ Sr=0\text{–}0.5,$$

$$Ti/(Ba+Sr)=1.002\text{–}1.015,$$

$$Si=0.0005\text{–}0.01 \text{ and } Mn=0.000001\text{–}0.001.$$

Dope metals are roughly divided into two classes, i.e., trivalent metals and pentavalent metals. Trivalent metals include Y, La, Dy and Sb. Pentavalent metals include Nb, Ta, Bi, Mo and V. At least one of these metals in used and the total amount of these dope metals is in the range of from 0.0005 to 0.01. When the temperature is shifted to the high temperature side, Pb can be used in place of Sr.

Preferred embodiments Of the present invention will hereinafter be illustrated in detail by way of examples.

EXAMPLE 1

A surface-cleaned Ni substrate was placed in a vacuum chamber and a thin film of a barium titanate based composition was formed by using the barium titanate based composition as a target in a oxygen gas stream of 20 SCCM with an EB deposition method under an acceleration voltage of 5 kV and a filament current of 70 mA. Deposition speed was 300 Å/min. A film thickness of 5000 Å was obtained. No substrate heating was conducted. By burning the obtained film at 700° C. in the air after film formation, a thin film exhibitng PTC characteristic was obtained.

The proportion by g-atms of metals in the composition was:

Ti/Ba/Sr-/Si/Sb/Mn=1/0.771/0.203/0.00198/0.00199/0.0-0001

Au deposition was conducted on the barium titanate based thin film thus obtained to form an electrode. Thus the thermistor illustrated in FIG. 2(*b*) was prepared.

In FIG. 2(*b*), 7 is a nickel plate, 8 is a thin film of barium titanate based composition and 9 is Au. Resistance was measured as a function of temperature between point F and point I to evaluate the PTC characteristic. Temperature change was finely divided in the vicinity of transition region. For example, temperature was changed with about 0.1° C. portions and measurement was carried out with a voltammeter after confirming that equilibrium was sufficiently attained at the temperature. The same procedures were carried out in the following examples. Results are illustrated in FIG. 3.

As seen in the figure, the product exhibited a steep PTC characteristic and was confirmed to be satisfactory for use in a PTC thin-film thermistor.

The maximum resistance temperature variation rate $\alpha$ which is indicated by the above equation (1) was 2.1.

EXAMPLE 2

On a mirror-finished p-Si plate having a specific resistance of 0.01 Ω cm, a thin film of Pt was formed in a thickness of 0.1 μm with a vacuum deposition method. A uniform solution containing isopropoxide of each metal in isopropyl alcohol was successively coated on the Pt film with a spin coating method. The coated substrate was heated to 800° C. at a temperature rise rate of 200° C./hr, allowed to stand for about an hour, and cooled to the room temperature at a rate of 100° C./hr.

Pt was deposited on the barium titanate base thin film thus obtained to form an electrode. A thermistor illustrated in FIG. 2(*a*) was obtained. Film thickness was 0.1 μm.

The proportion by g-atms of metals in the composition was:

Ti/Ba/Sr-/Si/Sb/Mn=1/0.833/0.159/0.00198/0.00198/0.0-0002

In FIG. 2(*a*), 1 is a p-Si substrate, 2 is Pt, 3 is a thin film of barium titanate based composition, and 4 is Pt. Resistance was measured as a function of temperature between point A and point B to evaluate the PTC characteristic. Results are illustrated in FIG. 3. As seen in FIG. 3, a steep PTC characteristic was obtained. The product was confirmed to be satisfactory for use in a PTC thin-film thermistor. The maximum resistance temperature variation rate α was 4.2, which value was obtained from enlarged drawing in FIG. 4.

EXAMPLE 3

The same procedures as described in Example 2 were carried out to prepare a thin film of a barium titanate based composition having a thickness of 3 μm.

A thermistor illustrated in FIG. 2(*a*) was prepared. Resistance was measured as a function of temperature between point A and point B to evaluate the PTC characteristic.

A steep PTC characteristic was exhibited. The product was confirmed to be satisfactory for use in a PTC thin-film thermistor.

The maximum resistance temperature variation rate α was 3.8 which value was obtained from enlarged drawing in FIG. 4.

EXAMPLE 4

The same procedures as described in Example 2 were carried out to prepare a thin film of a barium titanate based composition having a thickness of 5 μm.

A thermistor illustrated in FIG. 2(*a*) was prepared. Resistance was measured as a function of temperature between point A and point B to evaluate the PTC characteristic.

A steep PTC characteristic was exhibited. The product was confirmed to be satisfactory for use in a PTC thin-film thermistor. Maximum resistance temperature variation rate α was 2.2.

EXAMPLE 5

The same procedures as described in Example 2 were carried out to prepare a thin film of a barium titanate based composition having a thickness of 0.05 μm.

A thermistor illustrated in FIG. 2(*a*) was prepared Resistance was measured as a function of temperature point A and point B to evaluate the PTC characteristic.

A steep PTC characteristic was exhibited. The product was confirmed to be satisfactory for use in a PTC thin-film thermistor. Maximum resistance temperature variation rate a was 3.2.

The PTC thin-film thermistor of the present invention exhibits, as mentioned above, an extremely high PTC characteristic, that is, the resistance variation in the transition region is from 1 to 10 orders of magnitude and the maximum resistance temperature variation rate is from 1 to 20 order/°C. In addition, the thermistor can realize miniaturization of elements with a small area, can reduce current for use and can expect many applications such as circuit protection and switches.

What is claimed is:

1. A positive coefficient thin-film thermistor exhibiting a positive coefficient characteristic, having a thickness of from 0.005 to 5 μm, and comprised of a thin film and an electrode, said thin film comprising a barium titanate composition which contains Ti, Ba, Sr, Si, Mn and at least one doping metal wherein, in a g-atm ratio to Ti, Ba is in the range of from 0.5 to 1, Sr is from 0 to 0.5, Ti/(Ba+Sr) is from 1.002 to 1.015, Si is from 0.0005 to 0.01, and Mn is from 0.000001 to 0.001, and wherein the at least one doping metal is selected from Y, La, Dy, Sb, Nb, Ta, Bi, Mo and V in a ratio of the total number of g-atms of said doping metal to one g-atm Ti ranging from 0.0005 to 0.01.

2. A positive coefficient thin-film thermistor of claim 1 wherein the thermistor has a resistance variation in transition region of from 1 to 10 orders of magnitude and a maximum resistance temperature variation rate of from 1 to 20 orders/°C.

3. A positive coefficient thin-film thermistor of claim 1 wherein the thin film is formed by a method selected from vacuum deposition, sputtering, ion-plating, electro-deposition and coating.

4. A position coefficient thin-film thermistor of claim 3 wherein the thin film is formed by coating.

5. A positive coefficient thin-film thermistor of claim 4 wherein an active hydrogen containing compound is added to the coating solution.

6. A positive coefficient thin-film thermistor of claim 4 wherein a compound having chelate forming performance is added to the coating solution.

* * * * *